US007938066B2

(12) United States Patent
Scheid et al.

(10) Patent No.: US 7,938,066 B2
(45) Date of Patent: May 10, 2011

(54) STRIP CHARGE STORAGE ARRANGEMENT

(75) Inventors: Eric Scheid, Bloomington, IN (US); John A. Roark, Elnora, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1130 days.

(21) Appl. No.: 11/703,907

(22) Filed: Feb. 5, 2007

(65) Prior Publication Data

US 2010/0326308 A1 Dec. 30, 2010

(51) Int. Cl.
*F42B 3/00* (2006.01)
*F42B 3/10* (2006.01)

(52) U.S. Cl. ..... 102/331; D19/69

(58) Field of Classification Search ..... 102/331, 102/275.1, 275.5, 275.8; 225/510–534; D19/69
See application file for complete search history.

(56) References Cited

U.S. PATENT DOCUMENTS

| | | | | | |
|---|---|---|---|---|---|
| 2,681,186 | A * | 6/1954 | Slawik | 225/44 |
| 3,410,465 | A * | 11/1968 | Costello | 225/65 |
| 3,623,643 | A * | 11/1971 | Ikeda | 225/65 |
| 4,059,210 | A * | 11/1977 | Deering, Jr. | 225/47 |
| 4,826,557 | A * | 5/1989 | Fu et al. | 156/579 |
| 5,562,262 | A * | 10/1996 | Pennell | 242/588.3 |
| 6,085,955 | A * | 7/2000 | Hicks et al. | 225/78 |
| 6,145,722 | A * | 11/2000 | Behrens et al. | 225/42 |
| 6,616,087 | B1 * | 9/2003 | Chern | 242/559.2 |
| 2006/0213622 | A1 * | 9/2006 | Yu Chen | 156/577 |

* cited by examiner

*Primary Examiner* — Troy Chambers
(74) *Attorney, Agent, or Firm* — Christopher A. Monsey

(57) ABSTRACT

A storage arrangement for a strip charge includes a spool having a central aperture into which is placed an end of the strip charge, and a channel extending from the central aperture out to a peripheral wall around which the strip charge is wound. The channel includes a slightly curving portion so as not to unduly bend the strip charge. The spool is removably attached to a base plate that maintains the strip charge in place prior to use.

9 Claims, 6 Drawing Sheets

STRIP CHARGE STORAGE ARRANGEMENT

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The invention relates to explosive charges, and more particularly to a storage arrangement for an elongated flexible strip charge.

(2) Description of the Prior Art

A strip charge is an elongated flexible explosive device used, for example, to breach structures such as a door or wall. As currently stored, the strip charge is wound around itself and placed in a foil bag prior to use.

This method of storage causes cracks in the strip charge that prevents detonation and destroys the intended use of the strip charge. In addition, the tightly wound strip charge develops a shape memory which prevents natural unraveling of the strip charge after being secured to a target structure.

SUMMARY OF THE INVENTION

It is therefore a general purpose and primary object of the present invention to provide a storage arrangement for a strip charge that prevents cracks in the strip charge.

It is a further object of the present invention to provide a storage arrangement for a strip charge that minimizes the tendency to assume a shape memory.

To attain the objects described, there is provided a strip charge storage arrangement comprising a generally cylindrical spool having a top surface, a bottom surface and a peripheral wall. The spool includes an aperture extending from the top surface to the bottom surface. An open channel extends from the aperture to the peripheral wall and has a slightly curving portion.

In use, a strip charge is connected at one end to an initiator assembly within the aperture, is conducted through the channel, around the curved portion and is wound around the peripheral wall. To better maintain the strip charge on the spool, the spool is removable attached to a base plate, with removal taking place prior to deployment.

BRIEF DESCRIPTION OF THE DRAWINGS

Other objects, features and advantages of the present invention will become apparent upon reference to the following description of the preferred embodiments and to the drawings wherein.

DETAILED DESCRIPTION OF THE INVENTION

Figure 1:
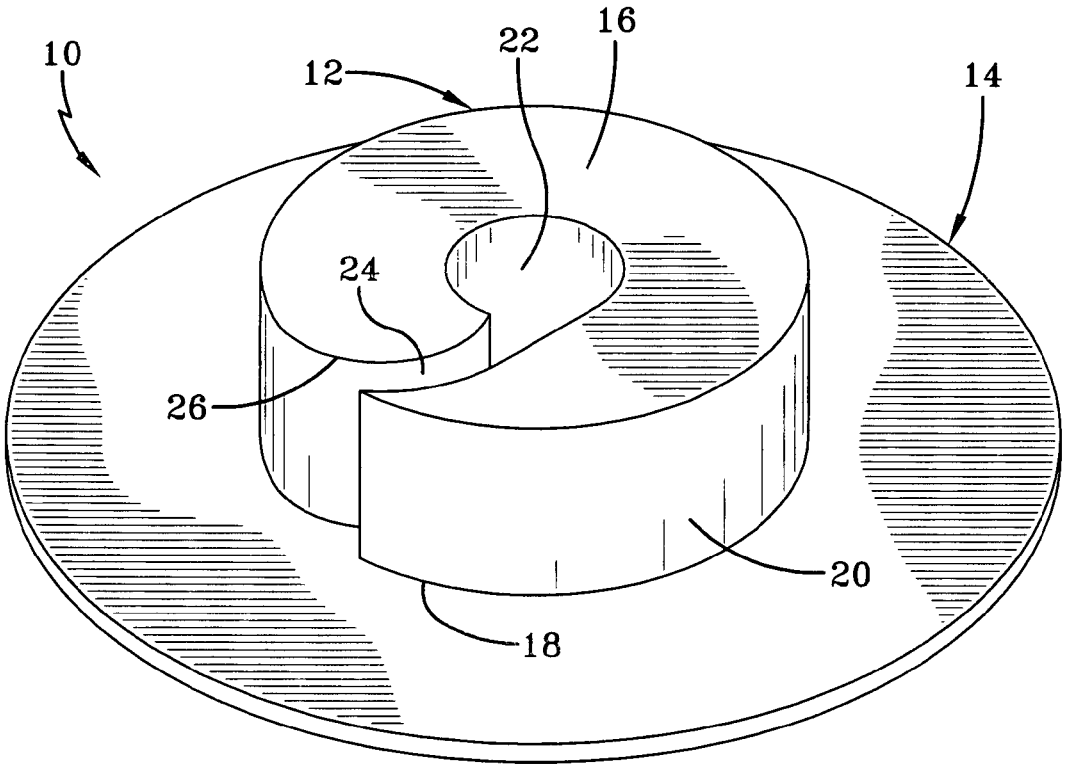
FIG. 1 depicts a strip charge storage arrangement in accordance with the present invention.

A more complete understanding of the invention and many of the attendant advantages thereto will be readily appreciated as the same becomes better understood by reference to the following detailed description when considered in conjunction with the accompanying drawings wherein like reference numerals and symbols designate identical and corresponding parts through the views.

Referring now to FIG. 1, there is illustrated a strip charge storage arrangement 10 which includes a spool 12 removably attached to a base plate 14.

The spool 12 has a top surface 16, a bottom surface 18 and a peripheral wall 20. An aperture 22 extends from the top surface 16 to the bottom surface 18 and is preferably centrally located. An open channel 24 extends from the central aperture 22 to the peripheral wall 20 and includes slightly and gently curving portion 26. Although the diameter of the spool 12 may vary, it is preferred that the minimum diameter is about three inches. Similarly, although the radius of curvature of the curved portion 26 may vary, it is preferred that the radius of curvature is at least about an inch and a half. Of course, the center of curvature of the curved portion 26 is different than the center of the spool 12. An exemplary width of the peripheral wall 20 is about one inch. The spool 12 may be made of any desired material, for example, rigid foam such as polyurethane foam.

Figure 2:
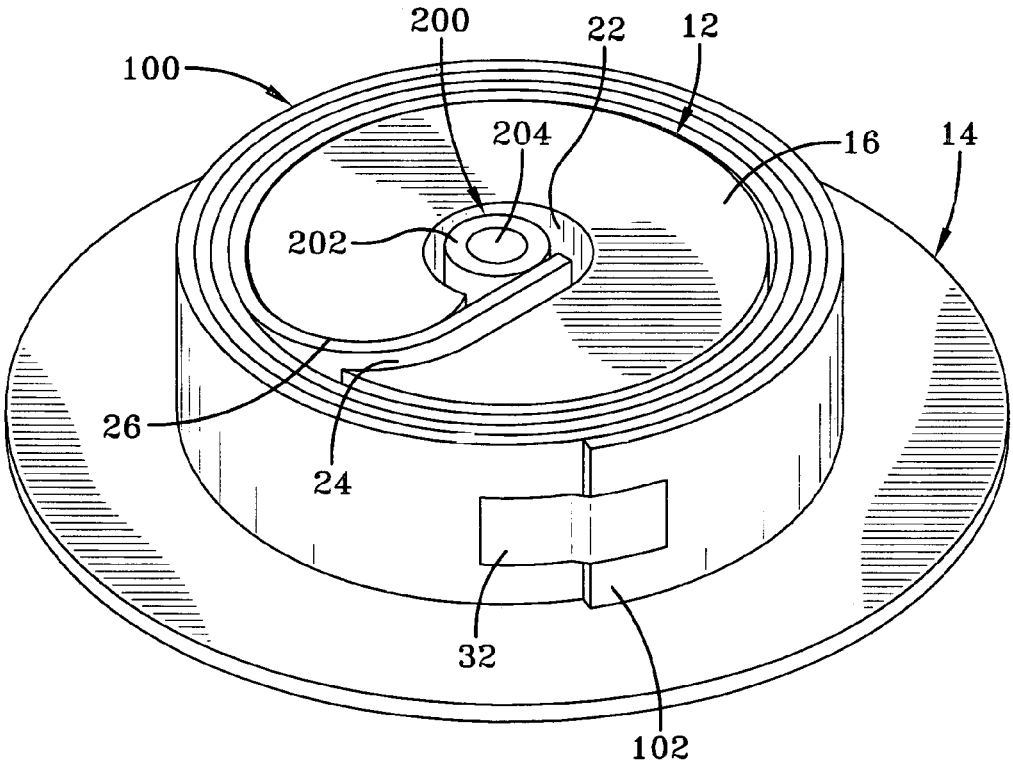
FIG. 2 depicts the strip charge storage arrangement with a strip charge attached.

FIG. 2 illustrates the strip charge storage arrangement 10 with an affixed strip charge 100, which is a belt-like elongated flexible explosive device. The strip charge 100 has one end that extends from the central aperture 22, is conducted through the channel 24, around the curved portion 26 and is wrapped around the peripheral wall 20 of the spool 12. A means is provided to prevent the strip charge 100 from unraveling while on the spool 12. In the embodiment of FIG. 2, this means tape 32 that secures an opposite end 102 of the strip charge 100 to the exposed portion of the strip charge itself.

To detonate the strip charge 100, there is provided an initiator assembly 200 within the aperture 22, which is connected to an end of the strip charge. The initiator assembly 200, by way of example, may be comprised of a booster 202 having a central opening into which is placed a detonator 204.

Figure 3:
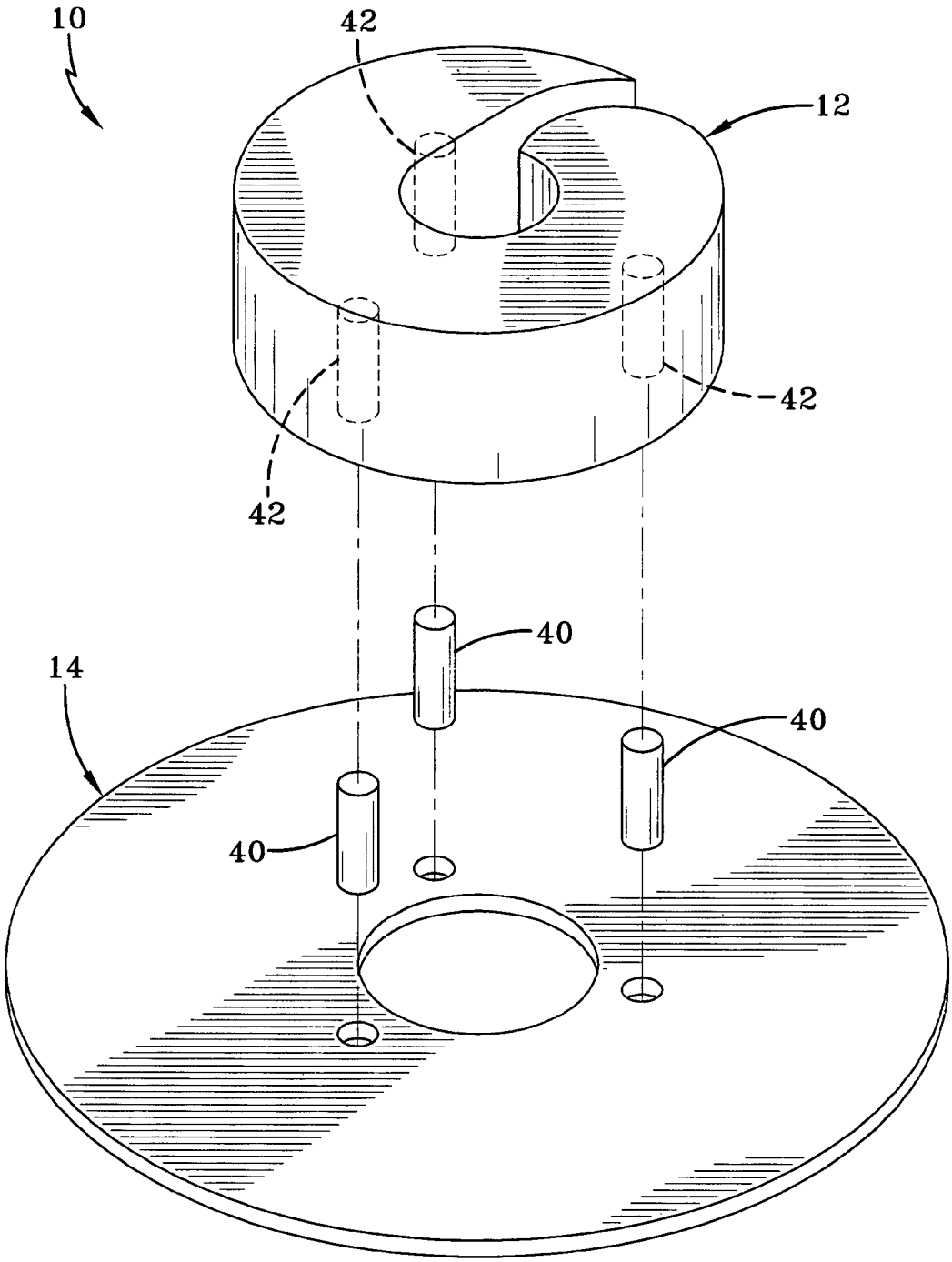
FIG. 3 is an exploded view of the strip charge storage arrangement.

FIG. 3 is an exploded view of the storage arrangement 10 and shows the base plate 14 to which is attached a plurality of pegs 40 arranged in a predetermined pattern. The spool 12 includes an undersurface with a series of cylindrical openings 42 arranged in the same pattern as that of the pegs 40 so that when the spool 12 is placed on the pegs; the spool is removably attached to the base plate 14. The base plate 14 prevents the strip charge 100 from slipping off the spool 12 prior to use.

Figure 4:
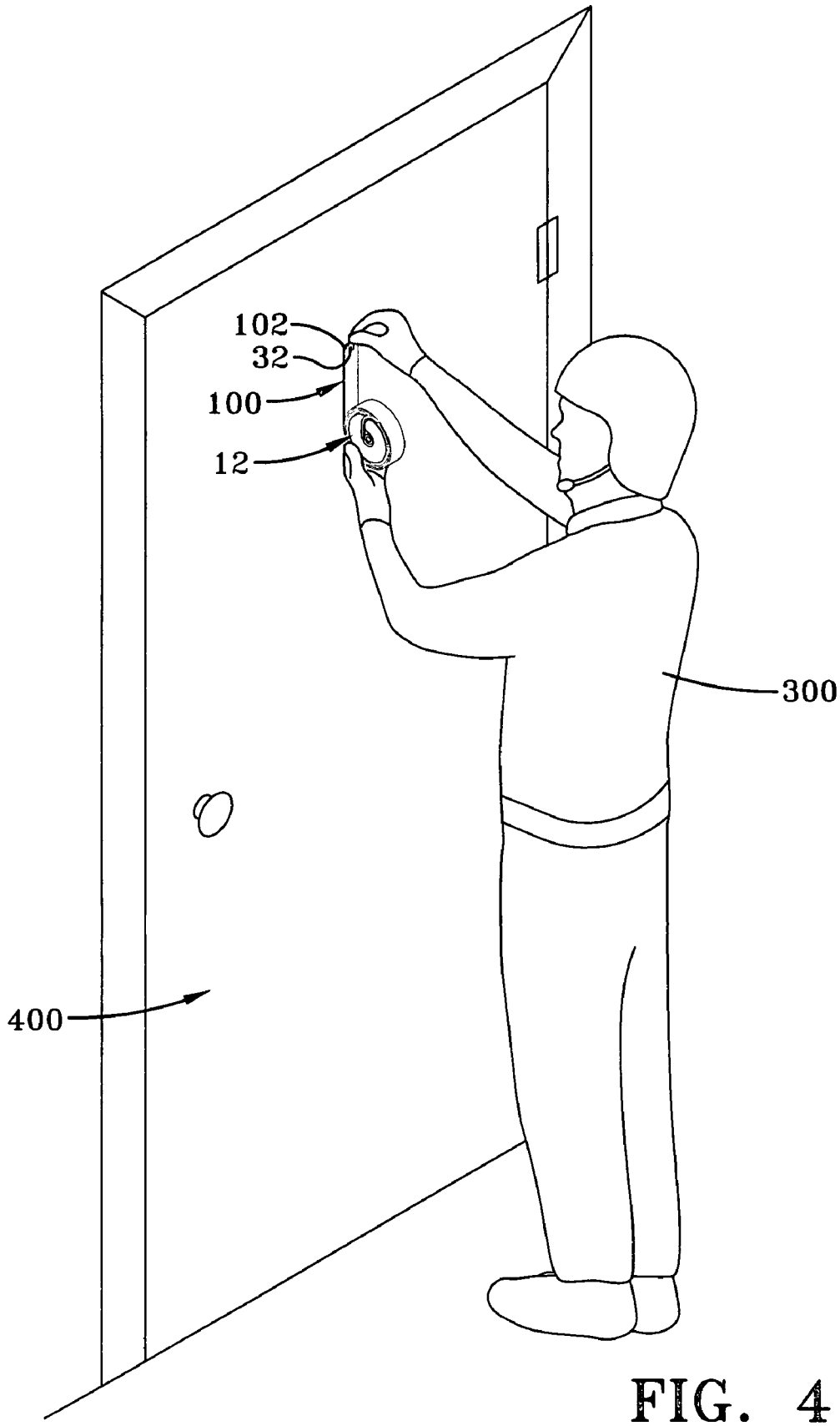
FIG. 4 illustrates a deployment of the strip charge.
Figure 5:
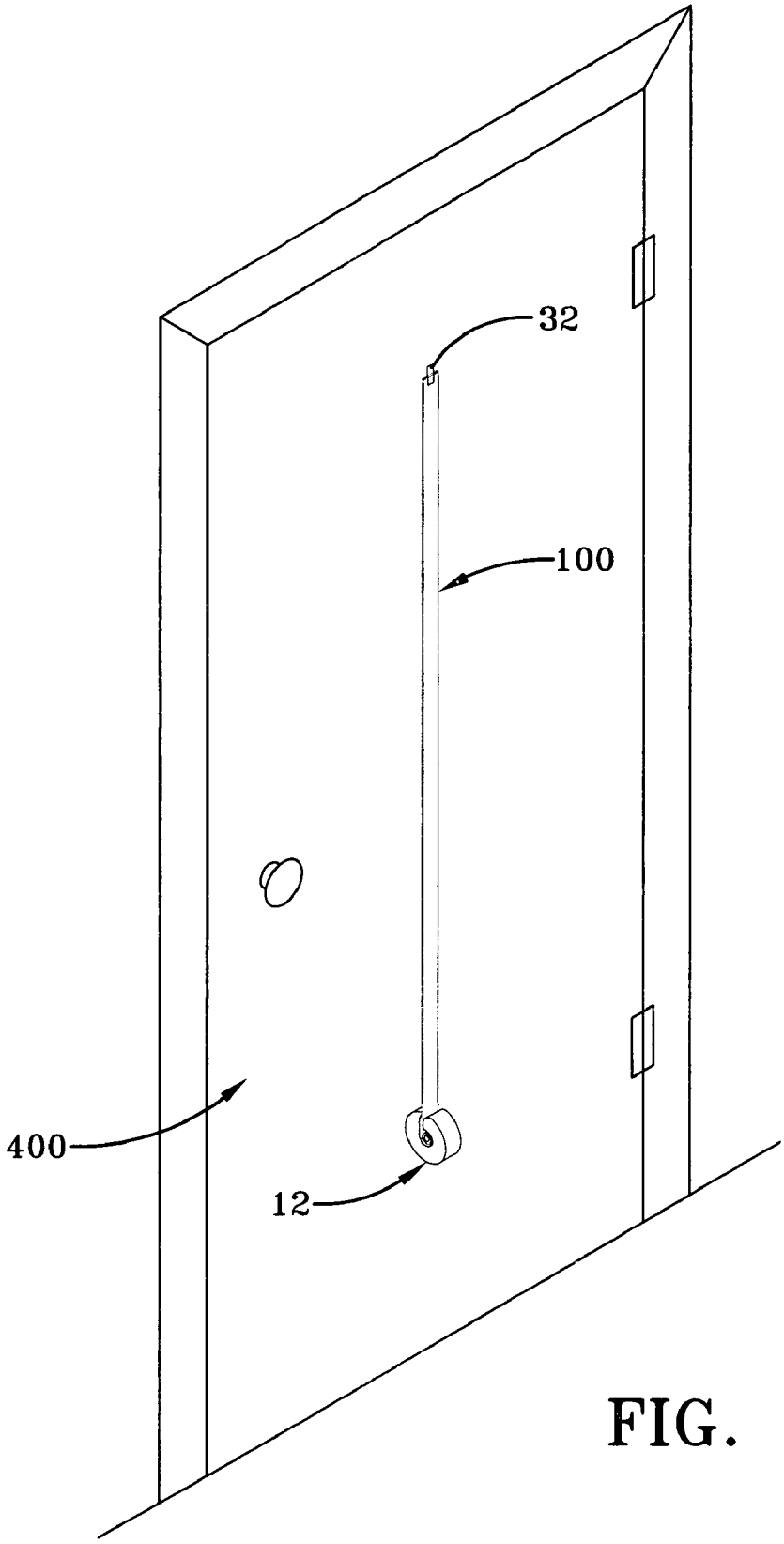
FIG. 5 also illustrates the deployment of the strip charge.

A typical deployment of the explosive charge is illustrated in FIG. 4 and FIG. 5. Prior to deployment, the base plate 14 is removed. In FIG. 4, a person 300 is using the tape 32 to tape the end 102 of the strip charge 100 to a structure to be breached. The structure, by way of example, is a door 400.

After taping the end 102 to the door 400, the spool 12 is released and falls by gravity to unroll the strip charge 100 until it is fully deployed, as illustrated in FIG. 5. With the present invention, the strip charge 100 does not develop a shape memory that would prevent the strip charge from unrolling under the force of gravity.

Figure 6:
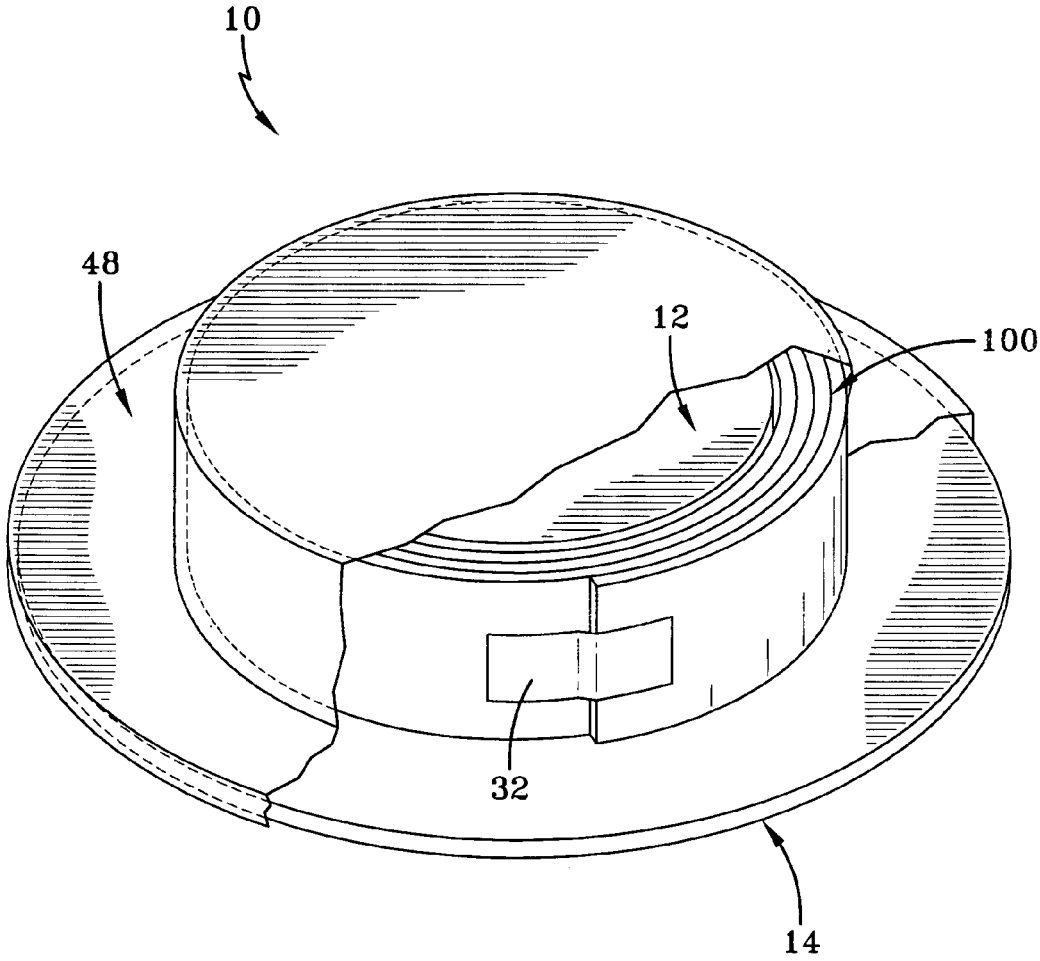
FIG. 6 illustrates a packaging for the strip charge storage arrangement.

It is preferred that the strip charge storage arrangement 10 be protected from the elements prior to use. FIG. 6 illustrates a protective system. The strip charge storage arrangement 10, including the spool 12, base plate 14, strip charge 100 and initiator assembly 200 (FIG. 2) is encased in a shrink wrap foil material 48 which is air-tight and fulfills the desired protection objective.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A strip charge storage arrangement comprising:

a generally cylindrical spool having a top surface, a bottom surface and a peripheral wall;

an aperture in said spool extending from said top surface to said bottom surface;

an open channel extending from said aperture to said peripheral wall, said open channel having a slightly curved portion;

a base plate removably attached to said spool;

a plurality of pegs extending from a surface thereof of said base plate in a pattern; and a plurality of cylindrical openings positioned in an under-surface of said spool to align for placement on said pegs.

2. A strip charge storage arrangement according to claim 1 further comprising a shrink wrap packaging encasing said storage arrangement.

3. A strip charge storage arrangement according to claim 1 wherein said spool is made of a rigid foam material.

4. A strip charge system comprising:

a generally cylindrical spool having a top surface, a bottom surface and a peripheral wall;

an aperture in said spool extending from said top surface to said bottom surface;

an open channel extending from said aperture to said peripheral wall, said open channel having a slightly curved portion; and a strip charge positioned on said spool and extending from said aperture, along said channel, around said curved portion and wrapped around said peripheral wall of said spool.

5. The strip charge system according to claim 4 further comprising an initiator assembly connected to an end of said strip charge within said aperture.

6. The strip charge system according to claim 4 further comprising a means to prevent unraveling of said strip charge when wound on said spool.

7. The strip charge system according to claim 6 wherein said means to prevent unraveling is a piece of tape connecting the end of said strip charge to an exposed portion of said strip charge.

8. The strip charge system according to claim 7 further comprising a shrink wrap packaging encasing said strip charge system.

9. The strip charge system according to claim 7 wherein said spool is made of a rigid foam material.

* * * * *